US012324972B2

(12) United States Patent
Wu

(10) Patent No.: US 12,324,972 B2
(45) Date of Patent: Jun. 10, 2025

(54) EXPLOSION-PROOF HITTING BALL AND TRAINING DEVICE INCLUDING THE SAME

(71) Applicant: Azuni International Co., Ltd., Taichung (TW)

(72) Inventor: Li-Lan Wu, Taichung (TW)

(73) Assignee: AZUNI INTERNATIONAL CO., LTD., Taichung (TW)

( * ) Notice: Subject to any disclaimer, the term of this patent is extended or adjusted under 35 U.S.C. 154(b) by 185 days.

(21) Appl. No.: 18/363,225

(22) Filed: Aug. 1, 2023

(65) Prior Publication Data

US 2025/0041696 A1 Feb. 6, 2025

(51) Int. Cl.
*A63B 69/22* (2006.01)

(52) U.S. Cl.
CPC ..... *A63B 69/224* (2022.08); *A63B 2225/093* (2013.01)

(58) Field of Classification Search
CPC ..... A63B 69/20; A63B 69/22; A63B 69/224; A63B 71/0054; A63B 2071/0063; A63B 2071/0072; A63B 2209/00; A63B 2225/09; A63B 2225/093; A63B 2225/62
See application file for complete search history.

(56) References Cited

U.S. PATENT DOCUMENTS 318,766 A * 5/1885 Longden ..... A63B 69/30 482/89
426,944 A * 4/1890 Lovatt ..... A63B 69/30 482/89
547,730 A * 10/1895 MacLearn ..... A63B 69/224 248/583
3,022,072 A * 2/1962 Zinnow ..... A63B 69/224 446/490
5,674,157 A * 10/1997 Wilkinson ..... A63B 69/22 482/83
7,070,520 B1 * 7/2006 An ..... A63B 69/0091 473/149
7,704,194 B1 * 4/2010 Chen ..... A63B 69/224 482/90
7,766,799 B1 * 8/2010 Chen ..... A63B 69/224 482/85
7,927,260 B1 * 4/2011 Stalka ..... A63B 69/30 482/84
9,114,298 B2 * 8/2015 Ruggiero ..... A63B 69/20
9,782,651 B2 * 10/2017 Ruggiero ..... A63B 69/0084
11,471,739 B2 * 10/2022 Wu ..... A63B 71/023
11,745,073 B2 * 9/2023 Chen ..... A63B 69/224 482/90

(Continued)

FOREIGN PATENT DOCUMENTS

AU 8960491 A * 6/1992

*Primary Examiner* — Gary D Urbiel Goldner
(74) *Attorney, Agent, or Firm* — MUNCY, GEISSLER, OLDS & LOWE, P.C.

(57) ABSTRACT

An explosion-proof hitting ball and a training device including the same are provided, wherein the explosion-proof hitting ball includes: a tubular member made of plastic material and including an outer wall; and a ball member made of explosion-proof material and including a tubular wall and a ball wall, the tubular wall and the ball wall being transverse and connected to each other to form a chamber, the tubular wall being disposed around the tubular member and integrally connected to the outer wall by melting-connection.

9 Claims, 6 Drawing Sheets

(56) References Cited

U.S. PATENT DOCUMENTS

| | | | | |
|---|---|---|---|---|
| 2002/0198085 | A1* | 12/2002 | Wang | A63B 69/20<br>482/89 |
| 2011/0251024 | A1* | 10/2011 | Hu | A63B 69/224<br>482/90 |
| 2012/0135843 | A1* | 5/2012 | Goldy | A63B 69/224<br>482/90 |
| 2012/0149534 | A1* | 6/2012 | Fu | A63B 69/22<br>482/90 |
| 2013/0324372 | A1* | 12/2013 | Cuadrado | A63B 69/224<br>482/90 |
| 2015/0182833 | A1* | 7/2015 | Hu | A63B 69/224<br>482/87 |
| 2025/0041695 | A1* | 2/2025 | Wu | A63B 69/222 |

* cited by examiner

EXPLOSION-PROOF HITTING BALL AND TRAINING DEVICE INCLUDING THE SAME

BACKGROUND OF THE INVENTION

Field of the Invention

The present invention relates to an explosion-proof hitting ball and a training device including the same.

Description of the Prior Art

Hitting training device allows users to train their hitting strength, hitting posture, hitting accuracy, and responsiveness. Usually, the members used for hitting are filled with fillings to simulate the hitting training and to absorb the impact force to protect the user's hands. The very common filling is sponge, cotton, rubber chips, sand, foam material, or air.

However, when the cladding encapsulating the filling is broken, the filling will be spread on the ground, causing the environment to be messy and difficult to clean up. If the cladding breaks during the hitting practice, the filling can even burst and injure persons. If the filling is air, very loud noises will occur during the explosion of the cladding, which will scare persons, and the fragments of the cladding can cause injuries to persons when the cladding bursts.

The present invention is, therefore, arisen to obviate or at least mitigate the above-mentioned disadvantages.

SUMMARY OF THE INVENTION

The main object of the present invention is to provide an explosion-proof hitting ball and a training device including the same, which will not burst so that it can effectively avoid injuries and damages.

To achieve the above and other objects, an explosion-proof hitting ball is provided, wherein the explosion-proof hitting ball includes: a tubular member made of plastic material and including an outer wall; and a ball member made of explosion-proof material and including a tubular wall and a ball wall, the tubular wall and the ball wall being transverse and connected to each other to form a chamber, the tubular wall being disposed around the tubular member and integrally connected to the outer wall by melting-connection.

To achieve the above and other objects, a training device is provided, wherein the training device includes the explosion-proof hitting ball, and further includes: a base; and a connection rod assembly connected to the base and the explosion-proof hitting ball.

The present invention will become more obvious from the following description when taken in connection with the accompanying drawings, which show, for purpose of illustrations only, the preferred embodiment(s) in accordance with the present invention.

DETAILED DESCRIPTION OF THE PREFERRED EMBODIMENTS

Figure 1:
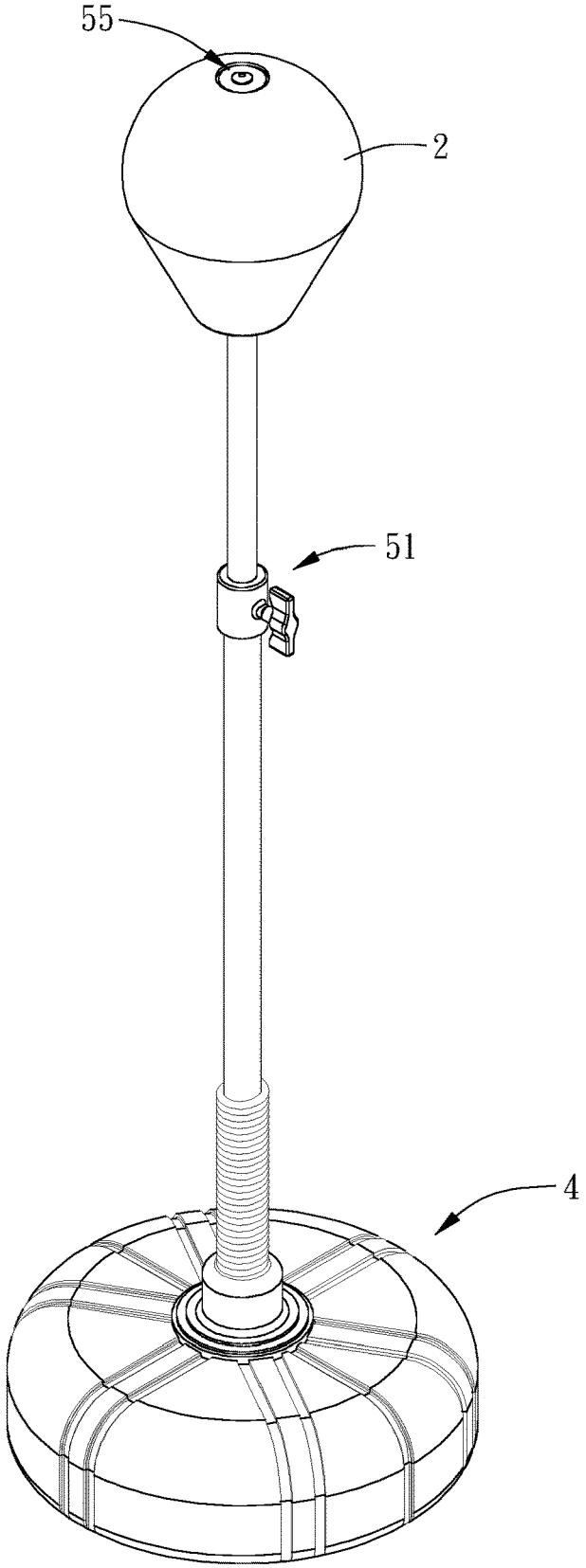
FIG. 1 is a stereogram of an exemplary embodiment of the present invention.
Figure 2:
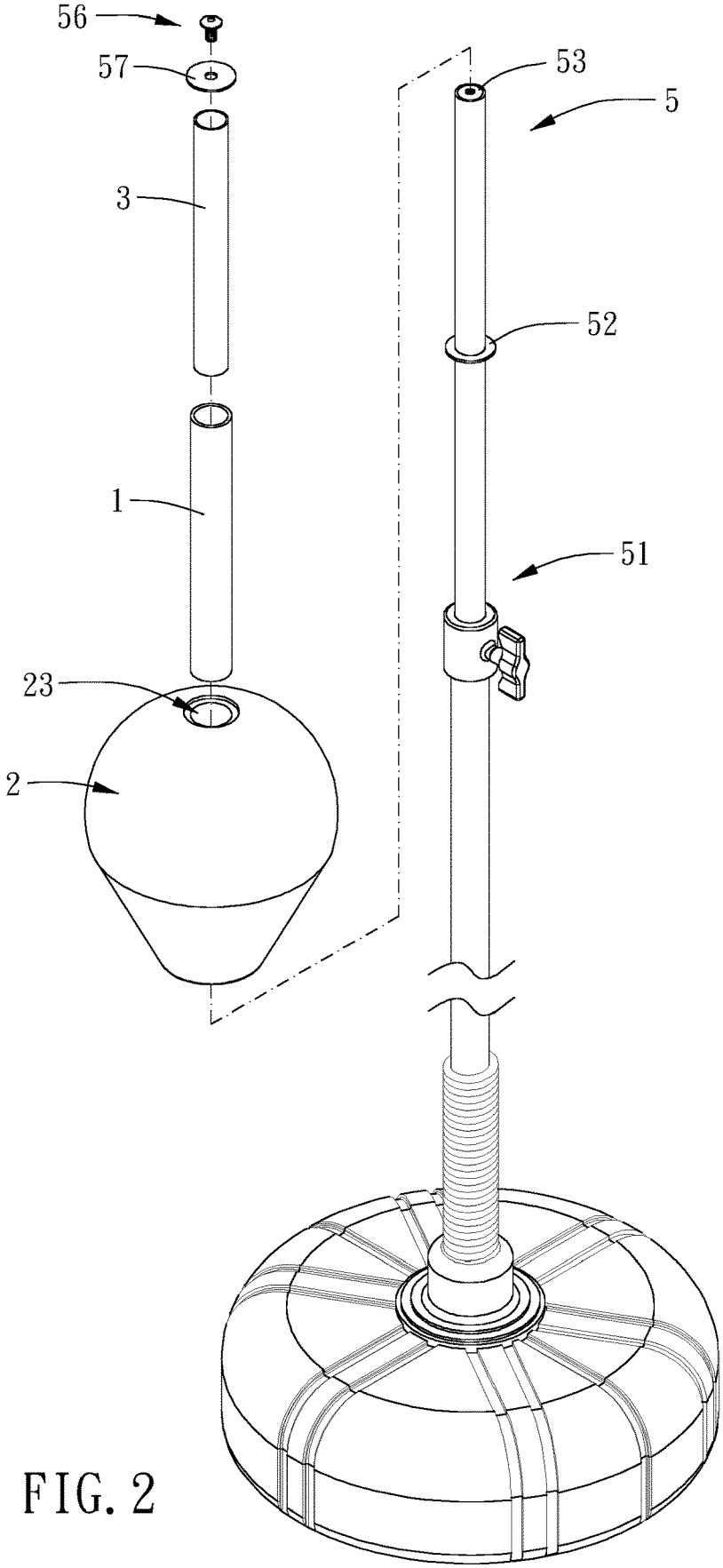
FIG. 2 is a breakdown drawing of an exemplary embodiment of the present invention.
Figure 3:
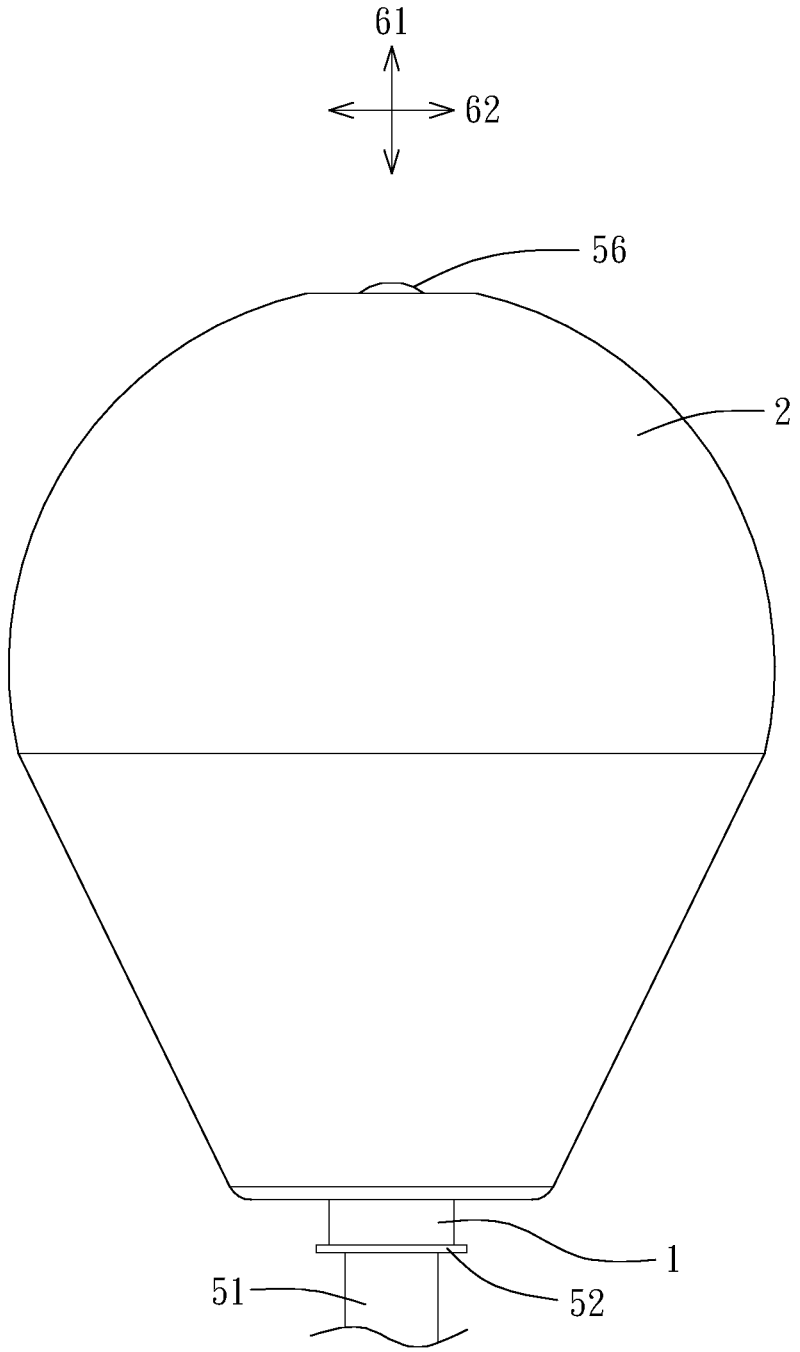
FIG. 3 is a partial enlargement of an exemplary embodiment of the present invention.
Figure 4:
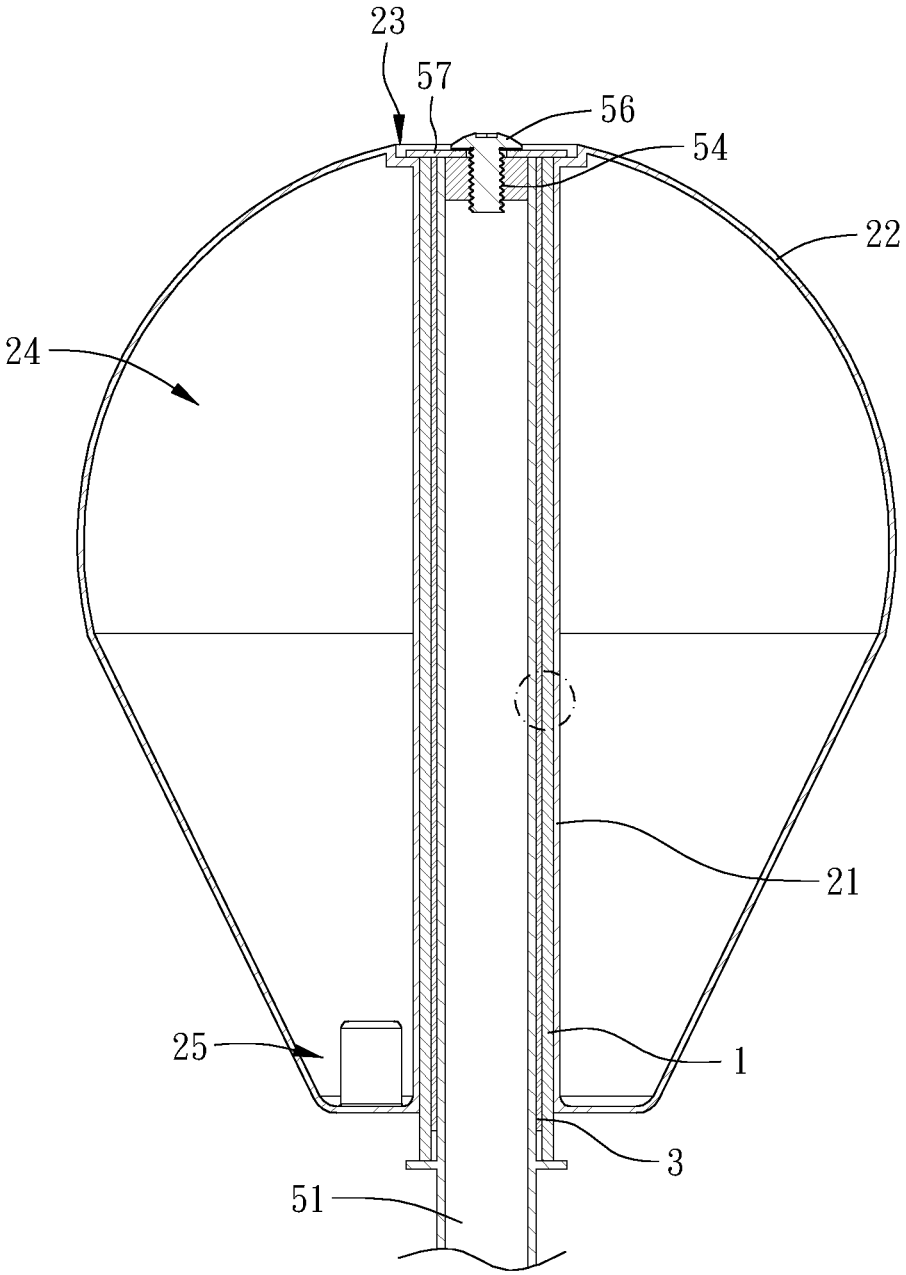
FIG. 4 is a cross-sectional view of FIG. 3.
Figure 5:
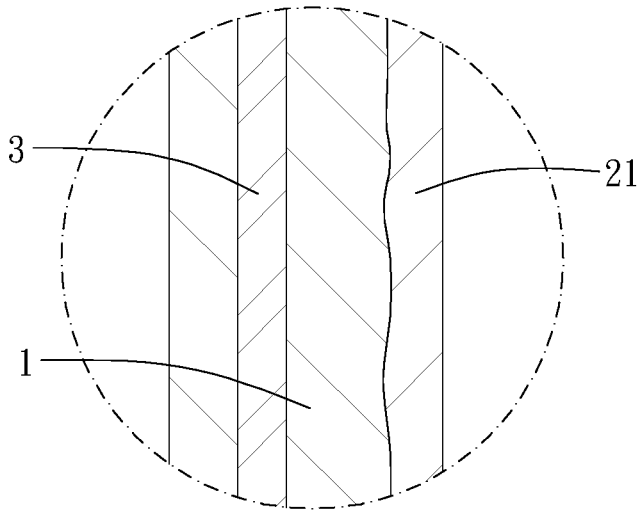
FIG. 5 is a partial enlargement of FIG. 4.
Figure 6:
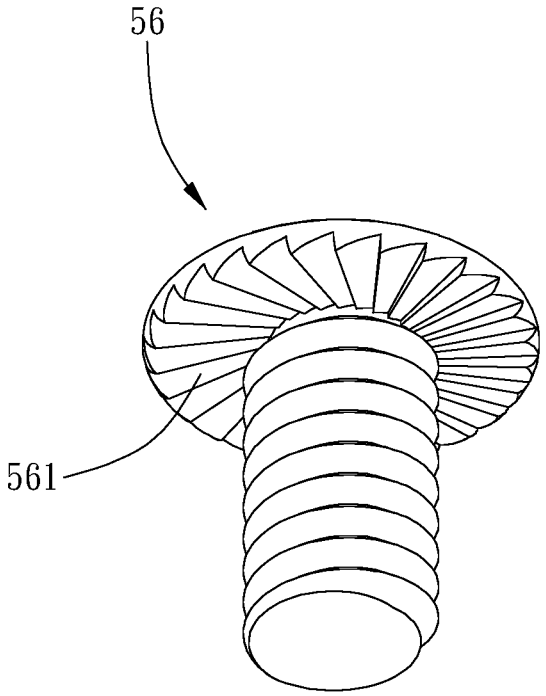
FIG. 6 is a stereogram of a screw of an exemplary embodiment of the present invention.

Please refer to FIGS. 1 to 6 for an exemplary embodiment of the present invention. An explosion-proof hitting ball of the present invention includes a tubular member 1 and a ball member 2.

The tubular member 1 is made of plastic material and includes an outer wall 11. The ball member 2 is made of explosion-proof material, the ball member 2 includes a tubular wall 21 and a ball wall 22, the tubular wall 21 and the ball wall 22 are transverse and connected to each other to form a chamber 24, and the tubular wall 21 is disposed around the tubular member 1 and integrally connected to the outer wall 11 by melting-connection. Preferably, the ball member 2 is made of polymer, such as polyvinyl chloride (PVC) or polypropylene (PP), the ball member 2 and the tubular member 1 are made of different materials, and the tubular wall 21 and the outer wall 11 are made of different materials and integrally connected to each other by melting-connection so that they are strongly connected to each other.

Preferably, the tubular member 1 is harder than the ball member 2. As such, when the tubular member 1 is disposed around an object, the harder tubular member 1 is not easy to damage and provides a strong support for supporting the ball member 2.

The tubular member 1 has a wall thickness larger than a wall thickness of the tubular wall 21 so that the tubular member 1 is durable and not easy to break. In this embodiment, the sum of a wall thickness of the tubular member 1 and a wall thickness of the tubular wall 21 is defined as a first dimension, a wall thickness of the ball wall 22 is defined as a second dimension, and the first dimension is larger than the second dimension. For example, the ratio of the first dimension and the second dimension ranges from 1.1 to 2.0.

Preferably, the tubular member 1 is protrusive beyond the ball member 2. When the explosion-proof hitting ball is disposed around a rod body, the tubular member 1 will contact a stop element first. When the explosion-proof hitting ball rotates relative to the rod body, the friction will concentrate on the harder tubular member 1, which can effectively maintain the structural integrity of the ball member 2 and service life.

The explosion-proof hitting ball further includes a metal tube 3, and the tubular member 1 is disposed around the metal tube 3, wherein the metal tube 3 has properties of low friction and good durability so that the explosion-proof hitting ball can smoothly move along the rod body. When the explosion-proof hitting ball is disposed around a rod body having low friction for hitting training, the explosion-proof hitting ball can smoothly rotate about the rod body to eliminate the impact force. Since the tubular member 1 made of plastic material has a relatively large frictional resistance than the metal tube 3, the tubular member 1 can rotate with the metal tube 3.

The explosion-proof hitting ball further includes a valve member 25, and the valve member 25 is disposed on the ball member 2 and controllably in communication with the chamber 24 and an outside of the ball member 2. As such, the user can inflate or deflate the ball member 2 to obtain a required air pressure in the chamber 24 according to various requirements, which can control the hardness of the ball member 2.

The invention further provides a training device. The training device includes the explosion-proof hitting ball, a base 4 and a connection rod assembly 5. The connection rod assembly 5 is connected to the base 4 and the explosion-proof hitting ball.

The connection rod assembly 5 includes a main portion 51, a blocking portion 52, a plug 53 and a fixation assembly 55. The main portion 51 is preferably retractable and defines an axial direction 61 and a radial direction 62. The blocking portion 52 projects in the radial direction 62 on a side of the main portion 51 remote from the base 4, the explosion-proof hitting ball is disposed around the main portion 51 about the axial direction 61 and abutted against the blocking portion 52. In this embodiment, the blocking portion 52 is abutted against the tubular member 1, the plug 53 is positioned in an opening of the main portion 51 remote from the base 4, and the fixation assembly 55 is connected to the plug 53 and blocks the explosion-proof hitting ball in the axial direction 61 so that the explosion-proof hitting ball cannot disengage form the main portion 51 during hitting training.

The ball wall 22 of the explosion-proof hitting ball includes a receiving hole 23, the receiving hole 23 has a diametric dimension larger than an inner diametric dimension of the tubular wall 21, the plug 53 includes a threaded hole 54 disposed therethrough, the threaded hole 54 is in communication with an interior of the main portion 51 and the receiving hole 23, the fixation assembly 55 includes a screw 56 and a washer 57, the washer 57 is received within the receiving hole 23 and abutted against an end of the tubular wall 21, and the screw 56 is disposed through the washer 57 and screwed to the threaded hole 54. Preferably, a side surface of the screw 56 facing the washer 57 includes a plurality of toothed portions 561, and the plurality of toothed portions 561 urge the washer 57 to effectively avoid disengagement of the screw 56.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. A training device comprising:

a base;

a connection rod assembly connected to and vertically extending upward from the base; and an explosion-proof hitting ball including:

a tubular member made of plastic material and including an outer wall; and a ball member made of explosion-proof material and including a tubular wall and a ball wall, the tubular wall and the ball wall being transverse and connected to each other to form a chamber, the tubular wall being disposed around the tubular member and integrally connected to the outer wall by a melting connection;

wherein the explosion-proof hitting ball is disposed around a proximal end of the connection rod assembly.

2. The training device of claim 1, wherein the tubular member is harder than the ball member.

3. The training device of claim 2, wherein:

the explosion-proof hitting ball further includes a metal tube, and the tubular member is disposed around the metal tube;

the tubular member has a wall thickness larger than a wall thickness of the tubular wall;

a sum of the wall thickness of the tubular member and the wall thickness of the tubular wall is defined as a first dimension, a wall thickness of the ball wall is defined as a second dimension, and the first dimension is larger than the second dimension;

the ball member and the tubular member are made of different materials, and the tubular wall and the outer wall are made of different materials and integrally connected to each other by the melting connection;

the tubular member is protrusive beyond the ball member;

the ball member is made of polyvinyl chloride (PVC) or polypropylene (PP);

a ratio of the first dimension to the second dimension ranges from 1.1 to 2.0; and the explosion-proof hitting ball further includes a valve member, and the valve member is disposed on the ball member and controllably in communication with the chamber and an outside of the ball member.

4. The training device of claim 1, wherein the tubular member has a wall thickness larger than a wall thickness of the tubular wall.

5. The training device of claim 1, wherein a sum of a wall thickness of the tubular member and a wall thickness of the tubular wall is defined as a first dimension, a wall thickness of the ball wall is defined as a second dimension, and the first dimension is larger than the second dimension.

6. The training device of claim 1, wherein the ball member and the tubular member are made of different materials, and the tubular wall and the outer wall are made of different materials and integrally connected to each other by the melting-connection.

7. The training device claim 1, further including a metal tube, wherein the tubular member is disposed around the metal tube.

8. The training device of claim 1, wherein the connection rod assembly includes a main portion, a blocking portion, a plug and a fixation assembly, the main portion defines an axial direction and a radial direction, the blocking portion projects in the radial direction on a side of the main portion remote from the base, the explosion-proof hitting ball is disposed around the main portion about the axial direction and abutted against the blocking portion, the plug is positioned in an opening of the main portion remote from the base, and the fixation assembly is connected to the plug and blocks the explosion-proof hitting ball in the axial direction.

9. The training device of claim 8, wherein the ball wall of the explosion-proof hitting ball includes a receiving hole, the receiving hole has a diametric dimension larger than an inner diametric dimension of the tubular wall, the plug includes a threaded hole disposed therethrough, the threaded hole is in communication with an interior of the main portion and the receiving hole, the fixation assembly includes a screw and a washer, the washer is received within the receiving hole and abutted against an end of the tubular wall, the screw is disposed through the washer and screwed to the threaded hole.

* * * * *